US012331505B2

(12) United States Patent
Hickey

(10) Patent No.: US 12,331,505 B2
(45) Date of Patent: Jun. 17, 2025

(54) SUPPORT BEAM FOR SCREENED ENCLOSURE AND CONNECTORS THEREFORE

(71) Applicant: Florida Sales & Marketing, LLC, Fort Meyers, FL (US)

(72) Inventor: Nicole Hickey, Ft. Meyers, FL (US)

(73) Assignee: Nico IP, LLC, Fort Myers, FL (US)

( * ) Notice: Subject to any disclaimer, the term of this patent is extended or adjusted under 35 U.S.C. 154(b) by 255 days.

(21) Appl. No.: 18/139,114

(22) Filed: Apr. 25, 2023

(65) Prior Publication Data

US 2023/0340773 A1 Oct. 26, 2023

Related U.S. Application Data

(63) Continuation of application No. 29/756,106, filed on Oct. 26, 2020, now Pat. No. Des. 984,679.

(51) Int. Cl.
*E04B 1/24* (2006.01)

(52) U.S. Cl.
CPC .... *E04B 1/2403* (2013.01); *E04B 2001/2421* (2013.01); *E04B 2001/2451* (2013.01); *E04B 2001/2457* (2013.01); *E04B 2001/2472* (2013.01)

(58) Field of Classification Search
CPC ..... E04B 1/2403; E04B 2001/2421; E04B 2001/2451; E04B 2001/2457; E04B 2001/2472; E04C 2003/0417; E04C 2003/043; E04C 2003/0456; E04C 2003/0465; E04C 3/06
See application file for complete search history.

(56) References Cited

U.S. PATENT DOCUMENTS 1,090,171 A * 3/1914 Schisler ..... E04C 3/04 52/844
3,256,671 A * 6/1966 Handley ..... E04C 3/06 52/844
6,131,362 A * 10/2000 Buecker ..... E04C 3/07 52/843
6,195,953 B1 * 3/2001 Gitter ..... E04C 3/06 52/843
6,385,941 B1 * 5/2002 Power, Jr. ..... E04C 3/40 52/579
6,430,888 B1 * 8/2002 Dombchik ..... E04H 3/16 52/656.5
6,601,362 B1 * 8/2003 Prince ..... E04F 19/022 52/844
6,668,495 B1 * 12/2003 Prince ..... E04F 19/022 52/656.1

(Continued)

*Primary Examiner* — Rodney Mintz
(74) *Attorney, Agent, or Firm* — Eckert Seamans Cherin & Mellott, LLC

(57) ABSTRACT

A beam system for a screened enclosure that includes one piece support beams having an internal channel and three or more spline grooves on one or more exterior sides. The spline grooves are designed to accept and secure screen material. Inserts positionable within the interior channel of adjacent beams may provide increased structural support for larger openings in the screened enclosure. The inserts generally include a central pillar having angular caps attached to opposing lateral edges thereof so that an insert fits snugly within the interior channel of the support beam. The inserts may be secured within the support beams by fastening elements.

18 Claims, 8 Drawing Sheets

(56) References Cited

U.S. PATENT DOCUMENTS 6,755,004 B1 * 6/2004 Power, Jr. ..... E04C 3/06 52/579
6,826,885 B2 * 12/2004 Raskin ..... E04C 3/40 52/844
7,568,323 B2 * 8/2009 Shelton ..... E04C 3/06 52/843
D603,065 S * 10/2009 Hamilton ..... D25/126
D620,619 S * 7/2010 Teffenhart, Jr. ..... E04C 3/06 D25/123
7,877,962 B2 * 2/2011 Teffenhart, Jr. ..... E04C 3/32 52/273
D636,095 S * 4/2011 Teffenhart, Jr. ..... E04C 3/06 D25/124
D666,743 S * 9/2012 Teffenhart, Jr. ..... D25/124
8,756,900 B1 * 6/2014 Hudson ..... E04C 3/07 52/844
D713,054 S * 9/2014 Teffenhart, Jr. ..... D25/61
D791,342 S * 7/2017 Teffenhart, Jr. ..... D25/61
D812,782 S * 3/2018 Dorman ..... D25/119
D830,545 S * 10/2018 Loughren ..... D24/126
D879,326 S * 3/2020 Hendry ..... D25/61
10,640,968 B2 * 5/2020 Teffenhart, Jr. ..... E04B 1/2403
11,072,922 B2 * 7/2021 Teffenhart, Jr. ..... E04B 1/1906
11,085,192 B2 * 8/2021 Mitchell ..... E04F 11/181
11,236,504 B2 * 2/2022 Ng ..... F24S 25/37
D954,301 S * 6/2022 Hendry ..... D25/131
D984,679 S * 4/2023 Hickey ..... E04C 3/06 D25/119
D991,493 S * 7/2023 Hickey ..... D25/126
11,891,792 B2 * 2/2024 Teffenhart, Jr. ..... E04B 1/2403
D1,018,903 S * 3/2024 Hickey ..... D25/119
D1,019,992 S * 3/2024 Hickey ..... D25/119
D1,035,048 S * 7/2024 Hickey ..... D25/126
D1,053,387 S * 12/2024 Hickey ..... D25/199
12,247,440 B2 * 3/2025 Hickey ..... D01F 6/62
2003/0145555 A1 * 8/2003 Raskin ..... E04C 3/40 52/844
2007/0074480 A1 * 4/2007 Kleila ..... E04H 3/16 160/201
2007/0266671 A1 * 11/2007 Chromy ..... E04C 3/06 52/844
2008/0016816 A1 * 1/2008 Kim ..... E04C 3/06 52/745.18
2008/0155932 A1 * 7/2008 McIntyre ..... E04B 1/0046 52/745.05
2008/0168738 A1 * 7/2008 Shelton ..... E04C 3/06 52/650.1
2008/0250737 A1 * 10/2008 Hall ..... E04C 3/06 52/223.9
2009/0178360 A1 * 7/2009 Teffenhart, Jr. ..... E04C 3/06 52/745.19
2011/0113717 A1 * 5/2011 Teffenhart, Jr. ..... E04C 3/06 52/655.1
2015/0316179 A1 * 11/2015 Jarvis ..... E04C 3/00 138/143
2019/0390453 A1 * 12/2019 Teffenhart, Jr. ..... E04B 1/388
2020/0018073 A1 * 1/2020 Mitchell ..... E04F 11/181
2020/0224404 A1 * 7/2020 Teffenhart, Jr. ..... E04B 1/1906
2020/0224407 A1 * 7/2020 Ng ..... E04B 1/388
2021/0180312 A1 * 6/2021 DiTrolio ..... F16B 2/12
2021/0302344 A1 * 9/2021 Teffenhart, Jr. ..... E04B 1/388
2024/0117623 A1 * 4/2024 Teffenhart, Jr. ..... E04B 1/1906
2024/0410223 A1 * 12/2024 Hickey ..... D03D 15/47

* cited by examiner

SUPPORT BEAM FOR SCREENED ENCLOSURE AND CONNECTORS THEREFORE

CROSS REFERENCE TO RELATED APPLICATIONS

The present application claims priority to U.S. Design patent application Ser. No. 29/756,106, filed Oct. 26, 2020, which is incorporated herein in its entirety.

TECHNICAL FIELD

This invention relates generally to beams for screened enclosures and methods for forming screened enclosures using the same.

BACKGROUND

Screened enclosures are commonly built to enclose patios, lanais, porches, swimming pools, decks, and other similar spaces. Such enclosures are generally constructed by installing vertical posts with horizontal beams spanning therebetween. Screen material, often in square or rectangular panels, will then fill the open spaces between the vertical posts and horizontal beams. In most cases, the screen panels forming the sides of the enclosure are secured to both the vertical posts and the horizontal beams.

Prior art posts and beams typically include two components that fit together to form a square or rectangular beam, i.e., self-mating beams or SMB systems. SMB systems may be secured together with or without the need for additional hardware or connectors. However, in the absence of additional connectors, such systems may have weaker structural integrity compared to other methods of joining, such as bolted or welded connections. Over time, self-mating beams may be prone to sagging or shifting, especially in areas with high winds or heavy rain, which could compromise the stability and durability of the enclosure. Moreover, SMB systems including connectors may require precise alignment and installation, which can be challenging for homeowners or contractors who are not experienced with this type of connection. Improper installation can result in misaligned or uneven sections, leading to gaps, leaks, or compromised structural integrity.

In large, screened enclosures, such as those featured in multi-story homes, the spacing between posts and beams may be expanded to form what is known as "picture windows." In such openings, the distances spanned by the posts and beams may be quite large and may extend beyond the range afforded by conventional posts and beams. Thus, even oversized beams, which may be 2"×6" to 2"×10" in size, may not be sufficient.

Accordingly, there is a need for systems that are easier to install, may have improved longevity and structural integrity, and may offer a greater range of design options.

SUMMARY

The present disclosure provides solutions to the aforementioned issues by providing one-piece extruded beams for screened enclosures that are lighter weight, easier to install, and afford greater installed longevity than prior art beams. The present disclosure further provides internal supports that may afford additional design options, providing secure connection between adjacent beams installed across large openings.

Accordingly, the present disclosure relates to a beam system for a screened enclosure. The system includes an elongated rectangular beam, i.e., support beam, having flat exterior sides and an interior channel extending longitudinally therethrough, and at least three spline grooves each adjacent an edge of the elongated rectangular beam. The spline grooves generally include an outward facing opening and a recessed portion, wherein the opening is configured to receive an edge of a screen panel and an elastomeric spline component to secure the screen panel to the rectangular beam.

According to certain aspects, a first exterior side of the elongated rectangular beam comprises a first spline groove that extends longitudinally along a length thereof, and a second exterior side adjacent to the first exterior side comprises second and third spline grooves that extend longitudinally along a length thereof. The first exterior side and a third exterior side may be sidewalls of the elongated rectangular beam each having a length less than the second exterior side and a fourth exterior side, which may be top and bottom walls of the elongated rectangular beam. According to this aspect, each of the third and fourth sides of the elongated rectangular beam are absent spline grooves.

According to certain aspects, the elongated rectangular beam may include four spline grooves each adjacent an edge of the elongated rectangular beam. Each of a second and forth exterior side of the elongated rectangular beam, which may be congruent sides, may comprise a first and second spline groove that extends longitudinally along a length thereof, and a third exterior side of the elongated rectangular beam may comprise a third and fourth spline groove that extends longitudinally along a length thereof.

According to certain aspects, the beam system may further comprise an insert sized and configured to fit within the interior channel of the rectangular beam, the insert comprising a central pillar having angular caps attached to opposing lateral ends, wherein the insert is configured to provide connection between two adjacent beams.

According to certain aspects, the angular caps may each comprise a first flat portion attached to the central pillar perpendicular thereto, two angled portions each attached to an opposite end of the first flat portion and extending outward away from the central pillar but inward toward a middle of the central pillar, and two second flat portions each attached to an end of the second angled portions and extending parallel with and inward toward a middle of the central pillar. The first flat portion of each angular cap generally fits against an inner side wall of the elongated rectangular beam, and wherein the second flat portions of each angular cap fit against inner top and bottom walls of the elongated rectangular beam.

According to certain aspects, the angular caps may each comprise a closed structure shaped as a pentagon having two right angles, wherein a first side of the closed structure that meets second and third sides at internal right angles faces an inner side wall of the elongated rectangular beam, wherein the closed structure is connected to the central pillar via a vertex of a fourth and fifth side of closed structure.

The angular caps of the inserts may each include a plurality of apertures extending along a longitudinal length thereof that are configured to provide connection with apertures in the elongated rectangular beam, such as via fastening elements.

The present disclosure further relates to kits comprising the beam system for a screen enclosure, i.e., a plurality of the rectangular beams and optionally any combination of (i) any of the inserts described hereinabove, (ii) sufficient amounts of precut screen panels and/or rolls of screen material, and (iii) elastomeric spline component.

The present disclosure further relates to kits configured for construction of a specific screened enclosure design, wherein the kits may include materials sized and configured for construction of the specific screened enclosure design, along with instructions for assembly. The kit may further include sufficient amounts of precut screen panels or rolls of screen material, and elastomeric spline component.

BRIEF DESCRIPTION OF THE DRAWINGS

Aspects, features, benefits, and advantages of the embodiments herein will be apparent with regard to the following description, appended claims, and accompanying drawings. In the following figures, like numerals represent like features in the various views. It is to be noted that features and components in these drawings, illustrating the views of embodiments of the present invention, unless stated to be otherwise, are not necessarily drawn to scale.

DETAILED DESCRIPTION

Figure 1:
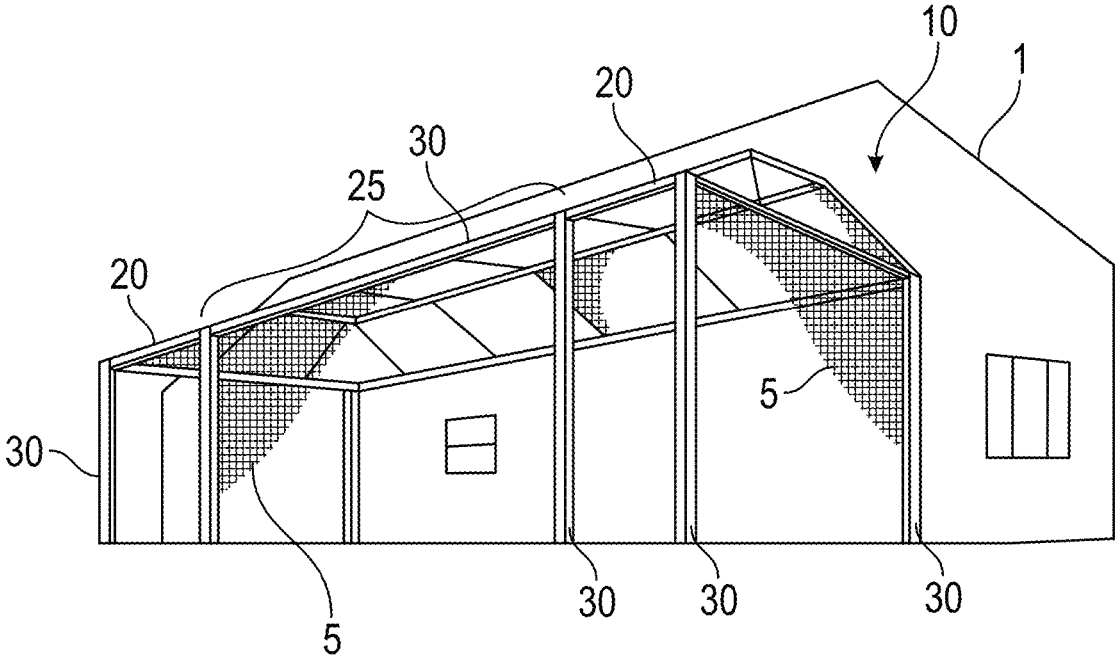
FIG. 1 illustrates a typical screened enclosure formed using support beams according to aspects of the present disclosure.

In the following description, the present invention is set forth in the context of various alternative embodiments and implementations involving elongated rectangular beams for a screened enclosure, such as an enclosure useful to surround and enclose patios, lanais, porches, swimming pools, decks, and other similar spaces. The present invention further sets forth methods of forming a screened enclosure using the elongated rectangular beams.

Definitions and Abbreviations

Various aspects of the elongated rectangular beam and methods for forming a screened enclosure using the beams may be illustrated with reference to one or more exemplary implementations or embodiments. As used herein, the term "exemplary" means "serving as an example, instance, or illustration," and should not necessarily be construed as preferred or advantageous over other variations of the devices, systems, or methods disclosed herein. "Optional" or "optionally" means that the subsequently described event or circumstance may or may not occur, and that the description includes instances where the event occurs and instances where it does not. In addition, the word "comprising" as used herein means "including, but not limited to".

Various aspects of the elongated rectangular beam and enclosures formed therefrom may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Relative terms such as "lower" or "bottom" and "upper" or "top" and "left" or "right" may be used herein to describe one element's relationship to another element illustrated in the drawings. It will be understood that relative terms are intended to encompass different orientations of aspects of the elongated rectangular beam and enclosures formed therefrom in addition to the orientation depicted in the drawings. By way of example, if aspects of the elongated rectangular beam shown in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

As used herein, the term "substantially" may be taken to represent the inherent degree of uncertainty that may be attributed to any quantitative comparison, value, measurement, or other representation. Thus, the term substantially may mean an amount of generally at least about 80%, about 90%, about 95%, about 98%, or even about 99%.

It must also be noted that as used herein and in the appended claims, the singular forms "a", "an", and "the" include the plural reference unless the context clearly dictates otherwise. Thus, for example, reference to "a" fastening element is a reference to one or more fastening elements and equivalents thereof known to those skilled in the art, and so forth. Unless defined otherwise, all technical and scientific terms used herein have the same meanings as commonly understood by one of ordinary skill in the art.

Words such as "then," "next," etc. are not intended to limit the order of the steps; these words are simply used to guide the reader through the description of the methods.

Aspects of the Disclosure

Referring now to the drawings, FIG. 1 illustrates a typical screened enclosure 10 according to the present disclosure.

The screened enclosure is generally formed using elongated rectangular beams, referred to hereinafter as support beams, and/or support beams connected via internally positioned I-beams or connecting beams, referred to hereinafter as inserts. FIGS. 2-13 illustrate details of various embodiment support beams and inserts.

A screened enclosure 10 may be formed using the support beams in either the horizontal 20 or vertical 30 orientation, as shown in FIG. 1. The screened enclosure 10 may be attached to a building 1, such as shown in FIG. 1, or may be freestanding. Screen panels 5 are attachable to longitudinal edges of each of the support beams (20, 30), such as along all longitudinal edges of beams defining an opening.

Figure 2:
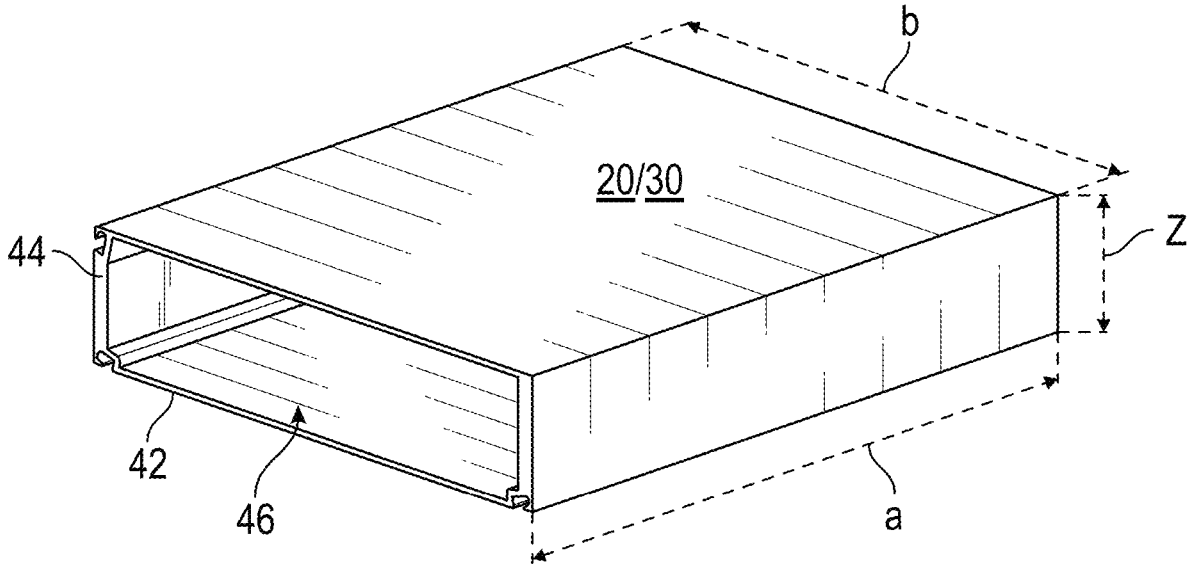
FIG. 2 illustrates a perspective view of a support beam according to aspects of the present disclosure.

With reference to FIG. 2, the support beams (20, 30) include an interior channel 46 that runs a full length of the beam. This reduces the weight and cost of the beam, and improves the ease of manufacturing, such as by extrusion technology. The support beams (20, 30) are generally rectangular, having four sides with flat exterior surfaces. The support beams (20, 30) may have a longitudinal length 'a' typically greater than 2 feet, such as 4, 6, 8, 10, 12 feet, or more in length. The support beams (20, 30) may have a width 'b' of from 4 inches to greater than 10 inches. According to preferred aspects, the support beams (20, 30) may have a width 'b' of about 6, 8, or 10 inches. Moreover, the support beams (20, 30) have a height 'z' of 1 inch to greater than 4 inches. According to preferred aspects, the support beams (20, 30) have a height 'z' of about 2 inches.

According to one embodiment, a first exterior side 44 (left or right) of the support beams (20, 30) include a spline groove that extends longitudinally along a length 'a' of the support beam. A second exterior side 42 (top or bottom) that is adjacent to the first exterior side 44 includes two spline grooves that extend longitudinally along a length 'a' of the support beam. The spline grooves are formed as recessed portions of each of the first and second exterior sides (44, 42, respectively).

Figure 3:
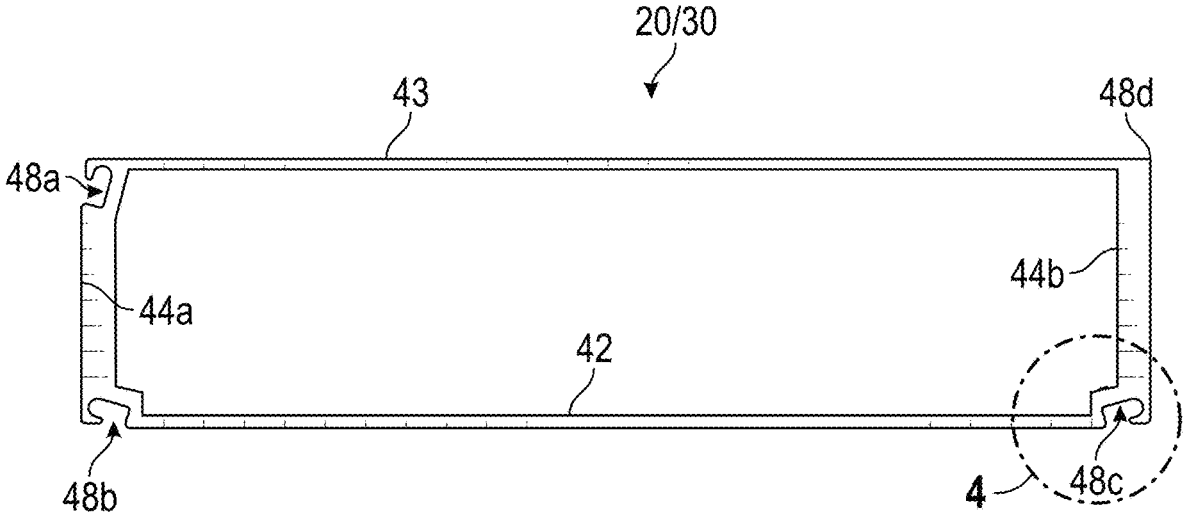
FIG. 3 illustrates an end view of the support beam shown in FIG. 2.

More specifically, and with reference to FIG. 3, a first exterior side 44*a* of the elongated rectangular beam (20, 30) comprises a first spline groove 48*a* that extends longitudinally along a length a thereof, and a second exterior side 42 adjacent to the first exterior side comprises second and third spline grooves (48*b*, 48*c*) that extend longitudinally along a length thereof. As shown, the first exterior side 44*a* and a third exterior side 44*b* are sidewalls of the elongated rectangular beam (20, 30) each having a length less than the second exterior side 42 and a fourth exterior side 43, which are bottom and top walls of the elongated rectangular beam, respectively. Each of the third and fourth sides of the elongated rectangular beam are absent spline grooves.

With reference to FIG. 3, the spline groove 48*a* of the support beam is positioned adjacent an edge of the first exterior side 44 such that an opening of the groove faces inward toward the center of the first exterior side 44. Further, the spline grooves (48*b*, 48*c*) on the second exterior side 42 of the support beam are positioned adjacent opposite edges thereof such that openings of each groove face inward toward a center of the second exterior side 42. A fourth corner 48*d* of the support beams (20, 30) may be absent a spline groove. When in use to form a screen enclosure, this fourth corner 48*d* presents a smooth surface.

Figure 4:
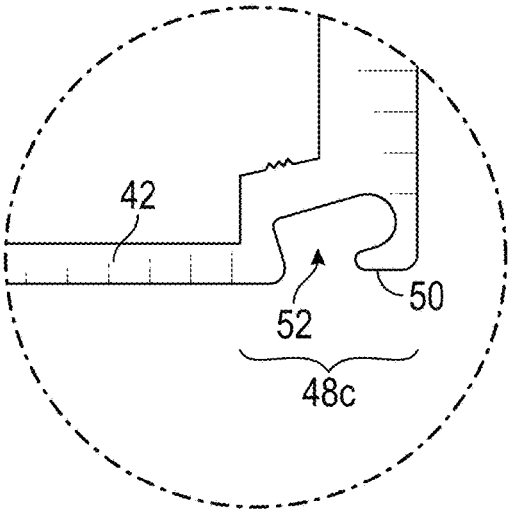
FIG. 4 illustrates a close-up detail of a section A of the support beam shown in FIG. 3.

With specific reference to FIG. 4, an enlarged view of a spline groove is shown, such as the spline groove 48*c* on the second side 42 (section A of FIG. 3). The spline grooves generally include an outward facing opening and a recessed portion 52. A section of the recessed portion 52 includes a cap or overhang 50 that may aid in securing an edge of a screen panel and an elastomeric spline component within the recessed opening 52 and thus to the support beam (20, 30). When the support beams are installed as the vertical and horizontal beams of an enclosure, the screen panels may be sized to fit within an opening defined by the support beams and may be secured along edges thereof within the splines on the beams. That is, an edge region of the screen may be positioned over the spline groove and an elastomeric spline component may be positioned on top of the screen and pushed into the recess 52 of the spline groove, wherein the overhang 50 secures the elastomeric spline component within the recess and secures the screen along an edge of the support beam.

Figure 12:
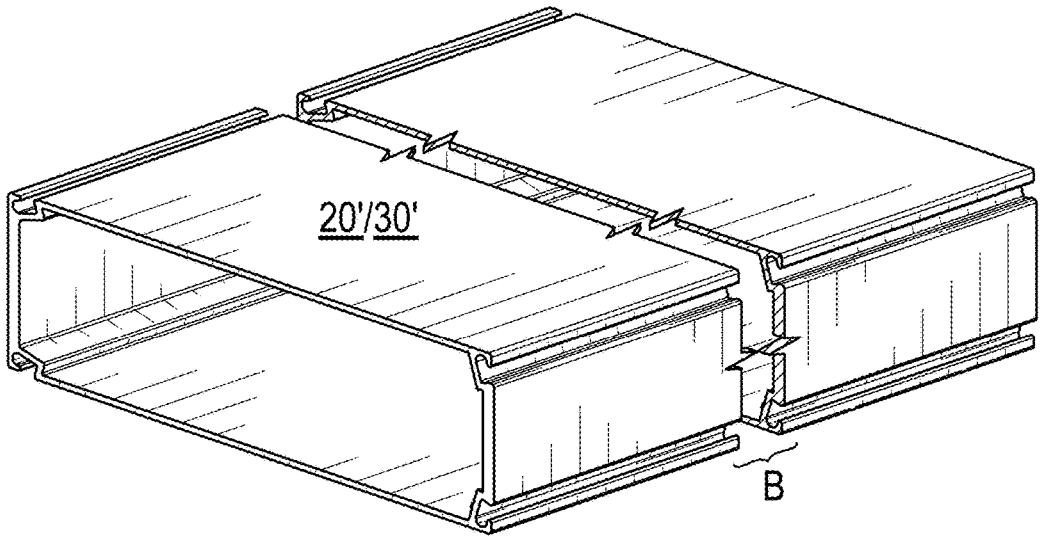
FIG. 12 illustrates a perspective view of a support beam according to aspects of the present disclosure.
Figure 13:
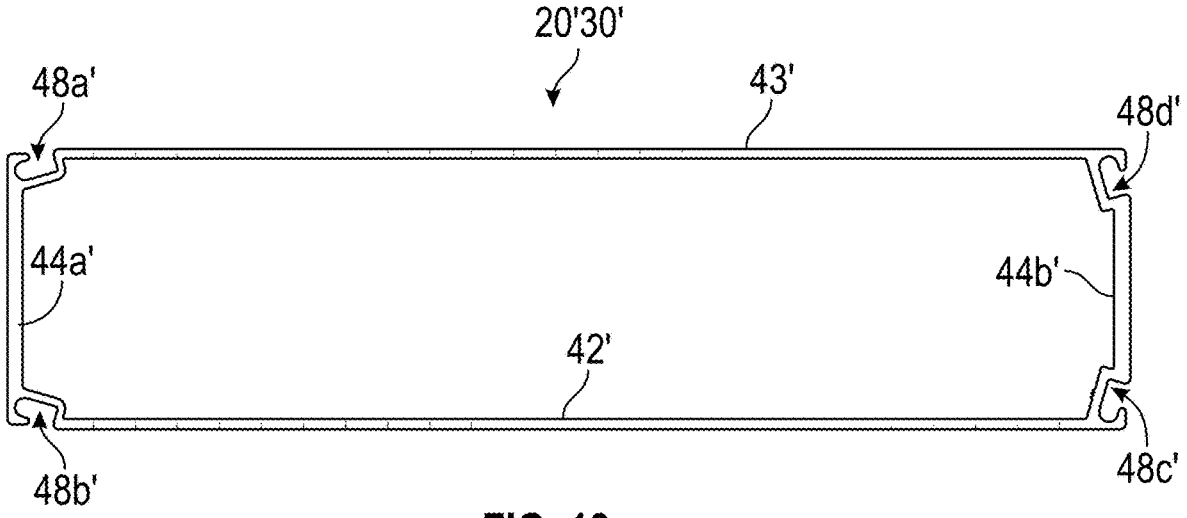
FIG. 13 illustrates an end view of the support beam shown in FIG. 9.

Shown in FIGS. 12 and 13 is another embodiment support beam (20', 30'). As shown, the support beam (20', 30') may include four spline grooves, wherein each spline is adjacent an edge of the support beam. As shown, each of a second 42' and fourth 43' exterior sides of the support beam are congruent sides and comprise a first 48*a*' and second 48*b*' spline groove, respectively, that extends longitudinally along a length of the support beam (20', 30'). A third exterior side 44*b*' of the support beam comprises a third and fourth spline groove (48*c*', 48*d*') that extends longitudinally along a length thereof.

The support beams disclosed herein may be used in either the vertical 20 or horizontal 30 orientation and may be positioned such that the spline grooves on respective sides provide attachment of screen panels on one face of an opening. The support beams shown in FIGS. 2 and 3 offer the additional advantage that when connected to form an enclosure, they may present a smooth surface along an opposite face of the opening (i.e., the exterior sides of the rectangular beams absent the spline grooves that are presented on the opposite opening).

The support beams (20, 30, 20', 30') may be used to provide vertical and horizontal beams for both the sides of an enclosure and a roof of the enclosure.

Extruded beams may lack the support needed to span large diameter openings, such as the opening 25 shown in FIG. 1. As a solution, an internal connecting beam, i.e., insert, may be included at junctions between two beams that span a large opening. Such inserts may increase the durability of the support beams (20, 30, 20', 30'), and thus reduce the risk of beam deformation when used across such large diameter spans.

Figure 5:
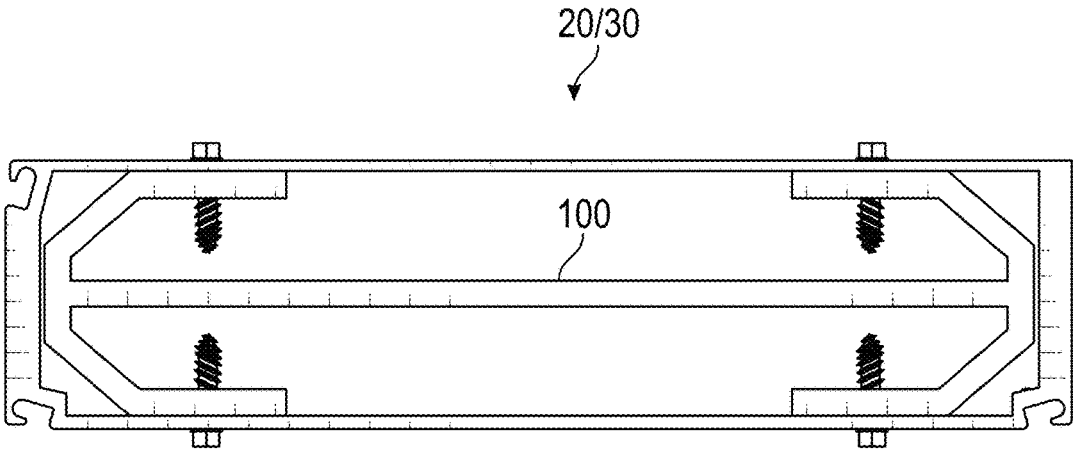
FIG. 5 illustrates an end view of an insert positioned within a support beam according to aspects of the present disclosure.

As shown in FIG. 5, the insert 100 may be positioned within the interior channel of the support beam (20, 30). For example, the insert 100 may be sized and configured to fit snugly within the interior channel of the support beam (20, 30) so that there is little movement therein. With specific reference to FIGS. 5 and 6, the width 'd' and/or height 'e' of the insert 100 may be substantially the same as the width and/or height, respectively, of the interior channel (46 of FIG. 2) of the support beam (20, 30) into which it is positioned. A longitudinal length of the insert 100 may be any length needed to provide connection and/or support between adjacent, i.e., abutting, support beams.

Figure 6:
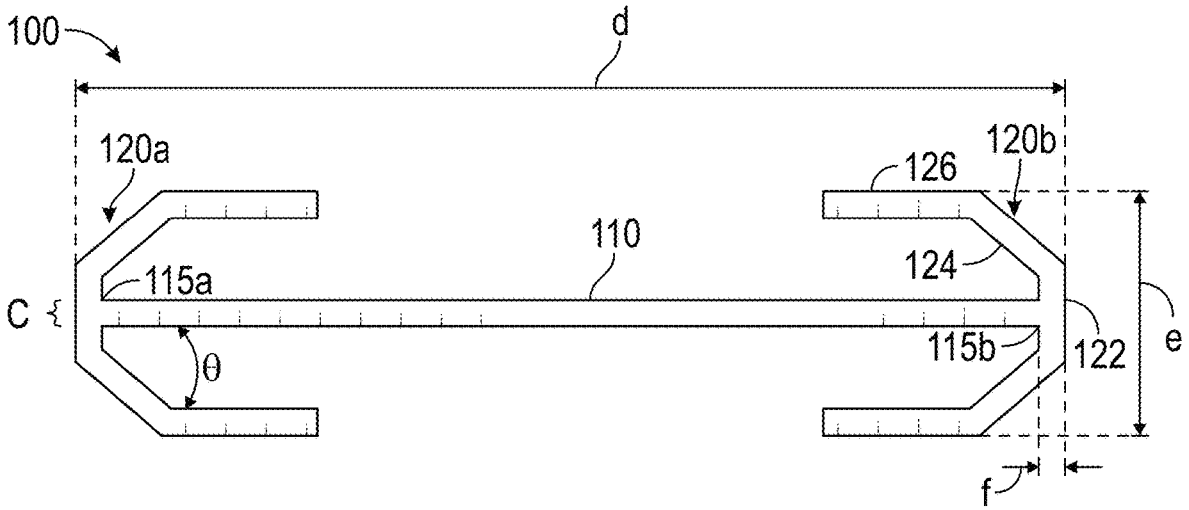
FIG. 6 illustrates an end view of the insert shown in FIG. 5.

With continued reference to FIG. 6, the insert 100 may include a central pillar 110 having angular caps (120*a*, 120*b*) attached to opposing lateral ends (115*a*, 115*b*), respectively, of the pillar. The angular caps (120*a*, 120*b*) each include a first flat portion 122 that is attached to a lateral end of the central pillar 110. Further, the first flat portion 122 is oriented perpendicular to the central pillar 110 and attached at a midpoint of the first flat portion. Each end of the first flat portion 122 generally includes an angled extension 124 that ends in a second flat portion 126.

The angled extension 124 extends away from the central pillar 110 at an angle q. Exemplary angles include at least 20°, or at least 30°, at least 40°, at least 50°, or even at least 60°. According to certain preferred aspects, the angled extension 124 of the angular cap (120*a*, 120*b*) extends away from the central pillar at an angle of about 40°. Moreover, the second flat portion 126 is oriented parallel with the central pillar 110. Each of the angled extension and the second flat portion extend inward toward an opposing end of the central pillar 110.

The thickness 'c' of the central pillar 110 and a thickness 'f' of the angular caps (120*a*, 120*b*) may be the same or different, and are designed based on a material and size of the insert 100 and support beam (20/30) into which the insert may be positioned.

Figure 7:
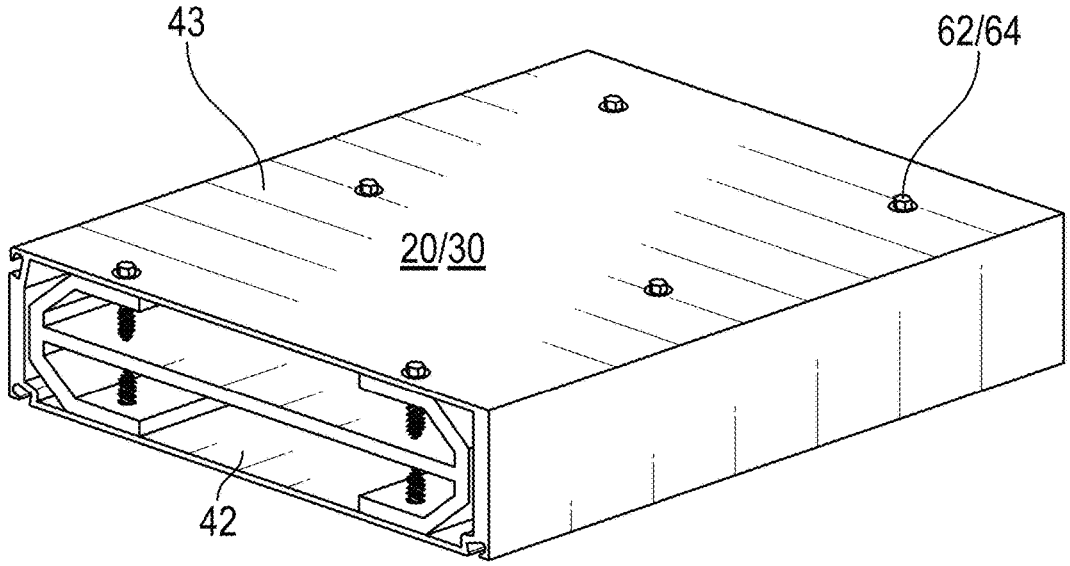
FIG. 7 illustrates a perspective view of an insert positioned within a support beam according to aspects of the present disclosure.

With reference to FIGS. 5-8, the inserts 100 may include apertures 60 positioned along the second flat portions 126 of the angular caps (120*a*, 120*b*), such as a single or double row of apertures 60 that extend longitudinally on the second flat portions 126. Moreover, the support beam (20/30) may include apertures 62 on a top side 43 and a second exterior side 42 (i.e., bottom side in FIG. 7) that are alignable with the apertures 60 of the insert 100 when the insert is positioned within the interior channel 46 of the support beam. In this way, the insert 100 may be secured within the interior channel 46 by fastening elements 64, such as screws as shown in FIGS. 5 and 7.

Figure 8:
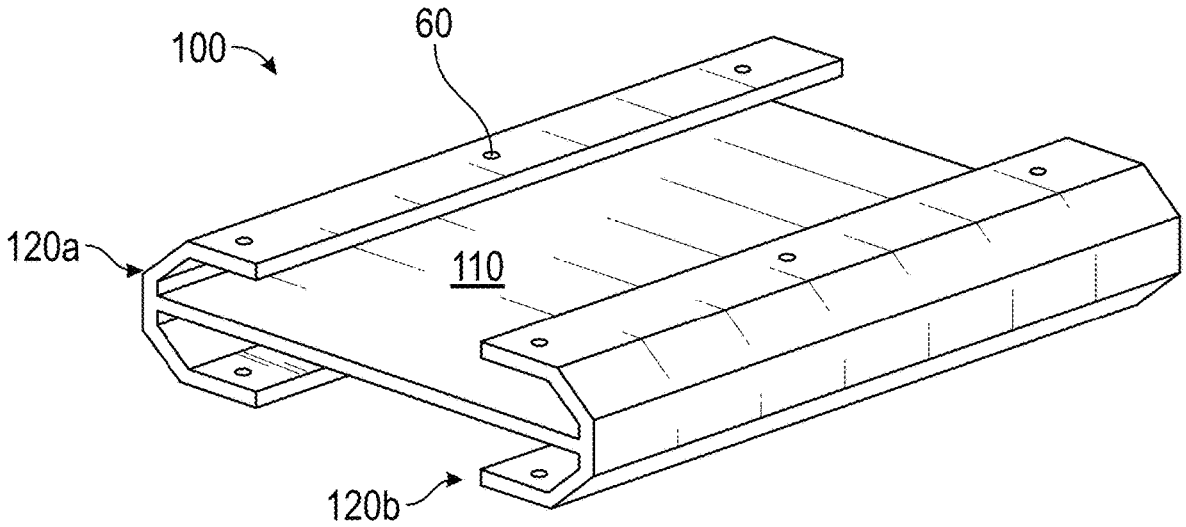
FIG. 8 illustrates a perspective view of the insert shown in FIG. 7.

The inserts may include a comparable number of apertures as the support beam, such as shown in FIGS. 7 and 8, or may include a greater number of apertures. When the insert includes a greater number of apertures, it offers a greater range of alignments for the insert within the support beam. For example, the insert 100 may be position between two support beams (20/30) and connected thereto via the apertures (60, 62) and fastening elements (64), thus providing secure connection of the two support beams.

Figure 9:
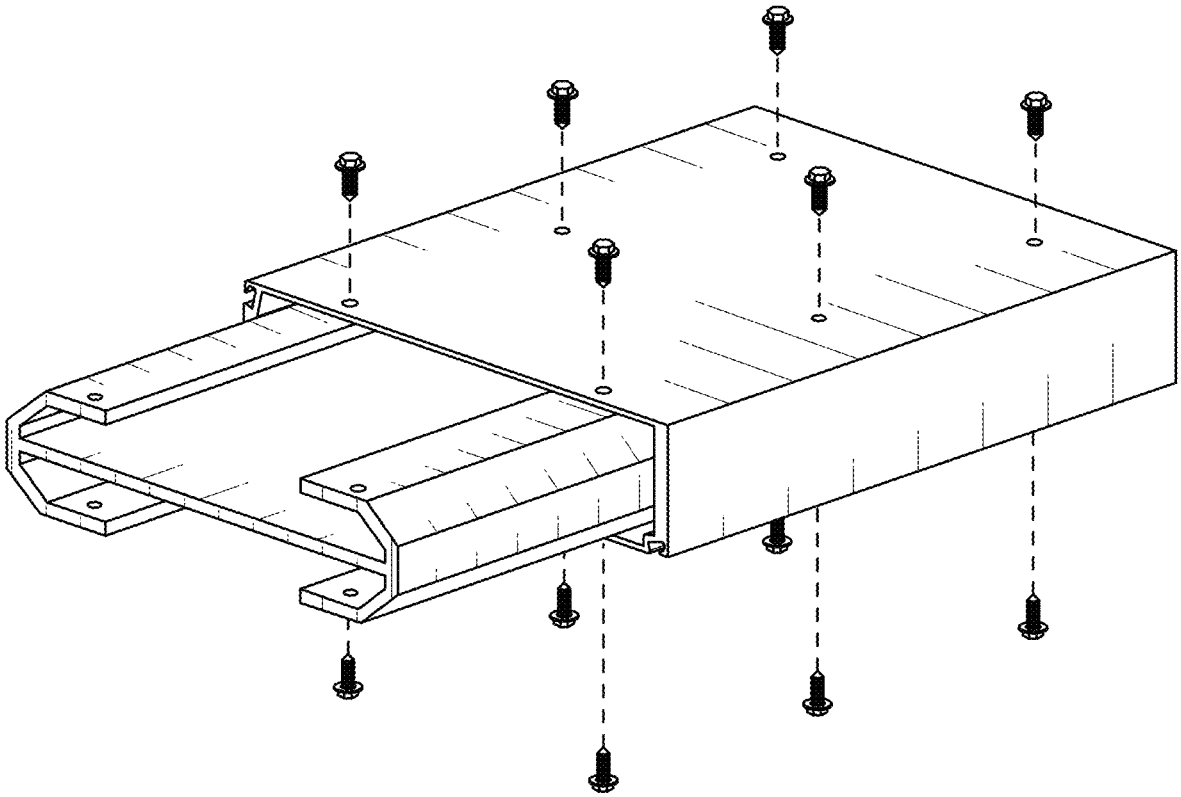
FIG. 9 illustrates a perspective view of an insert positioned within a support beam according to aspects of the present disclosure.

Shown in FIG. 9 is a support beam having a first end of an insert positioned therein, wherein a second end of the insert extends beyond the end of the support beam in preparation for connection to a second abutting support beam. Connection elements are shown ready to be inserted through aligned apertures for connection of the insert within the first support beam. While each of the insert and support beam are described as having preformed apertures configured to accept fastening means, such as screws and the like, such apertures may be formed in situ, such as during installation of the support beam. For example, an opening may be through a support beam having an insert positioned therein. The fastening means may then be positioned through the opening. Alternatively, a screw or other fastening means may be drilled through a support beam having an insert positioned therein.

Figure 14:
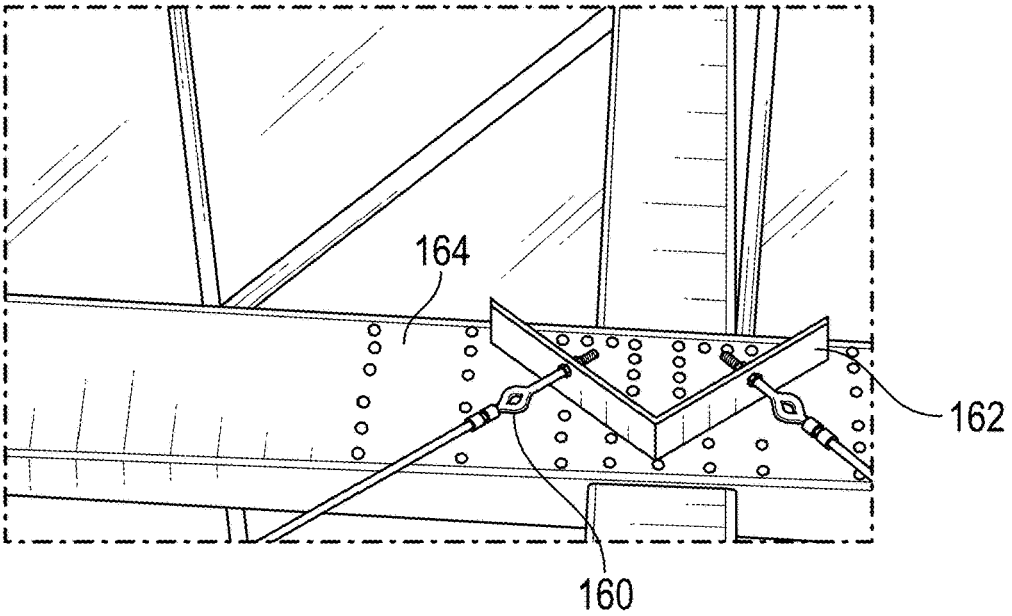
FIG. 14 illustrates a connection between support beams according to aspects of the present disclosure.

A view of the connection between two support beams is shown in FIG. 14, wherein fastening means are apparent on the exterior surface of the support beams. Also shown in FIG. 14 are support cables 160 that may be used to stabilize large openings within a screened enclosure. The support cables 160 may be fastened to attachment points 162 that are part of a connection plate 164, wherein the connection plate may be attached to connection regions between support beams, such as using the same fastening means that connect the insert and support beam (see FIG. 9).

Figure 15:
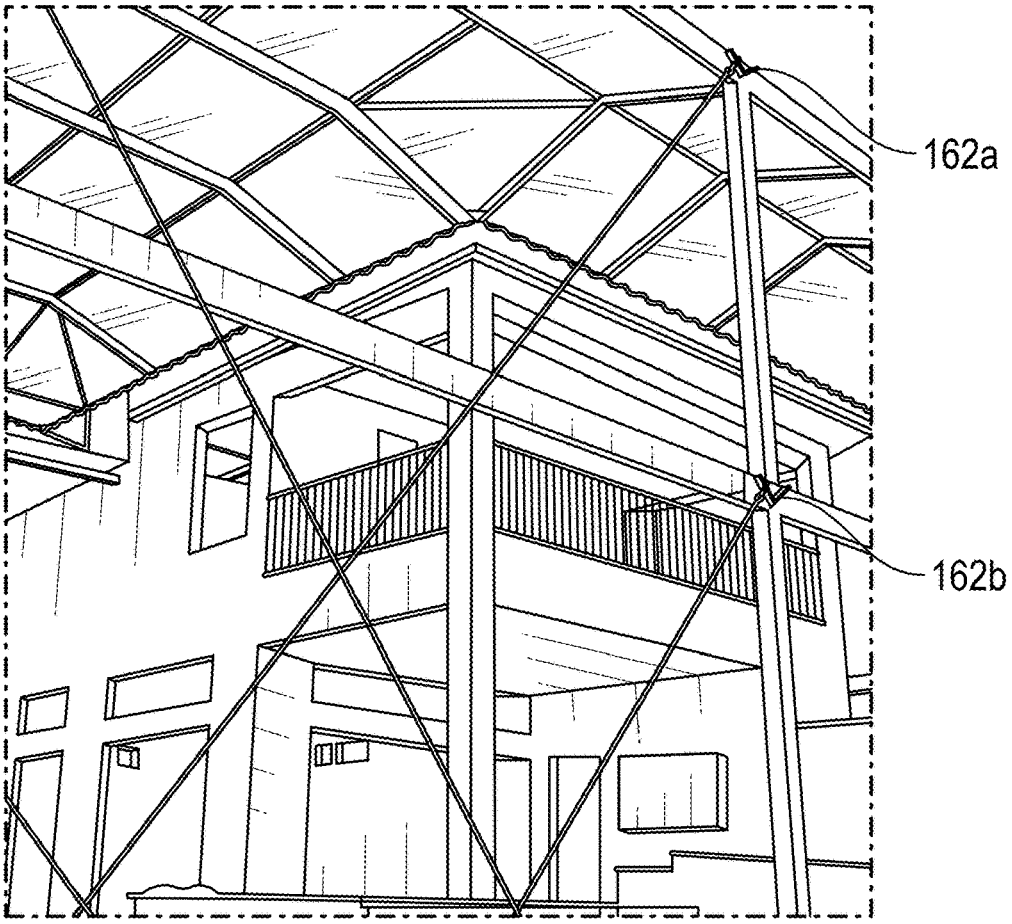
FIG. 15 illustrates support cables for large openings in a screened enclosure according to aspects of the present disclosure.

As shown in FIG. 15, the connection cables may extend across individual large openings, such as from a connection point 162*b* at one edge of an opening to a connection point at a diagonal edge of the opening, or to a region on a surface substantially coincident therewith. The connection cables may extend across multiple openings, such as from a connection point 162*a* at one edge of a first opening to a connection point at a diagonal edge of a second or third, etc., opening, or to a region on a surface substantially coincident therewith.

Figure 10:
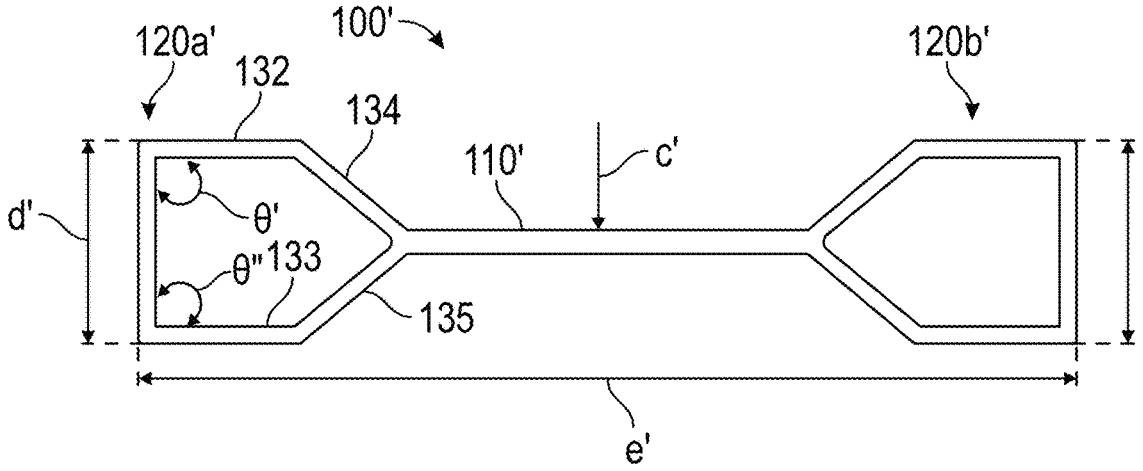
FIG. 10 illustrates an end view of an insert according to aspects of the present disclosure.
Figure 11:
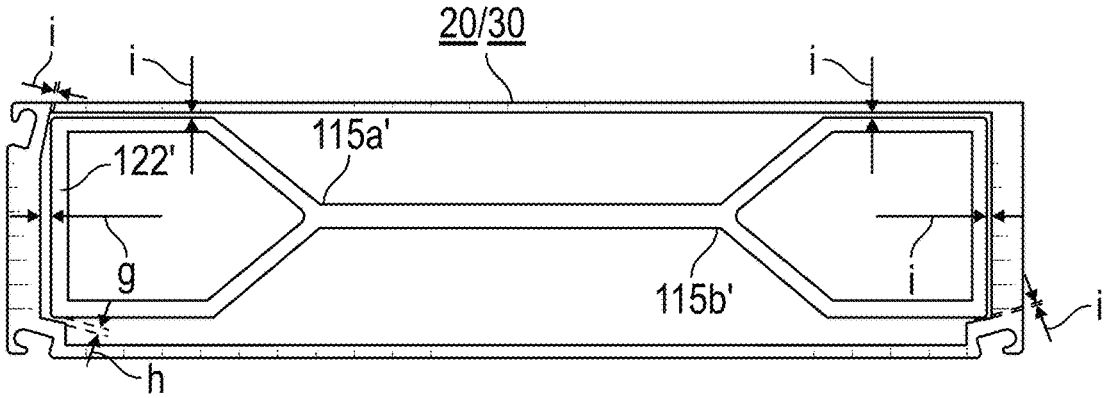
FIG. 11 illustrates an end view of the insert shown in FIG. 10 positioned within a support beam according to aspects of the present disclosure.

Another embodiment insert 100' is shown in FIGS. 10 and 11. The insert may include a central pillar 110' having angular caps (120*a*', 120*b*') attached to opposing lateral ends (115*a*', 115*b*'), respectively, of the pillar. The angular caps (120*a*', 120*b*') may individually comprise a closed structure shaped as a pentagon having two right angles, wherein a first side 122' of the closed structure that meets second and third sides (132, 133) at internal right angles (q', q") faces an inner side wall of the elongated rectangular beam (20/30). The angular caps (120*a*', 120*b*') may be connected to the central pillar 110' via a vertex of a fourth and fifth side (134, 135) of the closed structure.

As with the insert 100 shown in FIGS. 7 and 8, the insert 100' may include a plurality of apertures, such as in the second side 132 and third side 133 extending along a longitudinal length thereof. The apertures may be configured to align with some or all of a plurality of apertures in the support beam, such as the support beams shown in FIGS. 2 and 12. Aligned apertures of the support beam and the insert may be each configured to accept a fastening element and thus provide connection therebetween. Alternatively, such apertures may be formed in situ as described hereinabove.

With specific reference to FIG. 11, the insert 100' may be sized to fit within the interior channel of the support beam (20, 30) snugly, i.e., each of the first sides of the angular caps (120*a*', 120*b*') fit against inner side walls of the support beam (i.e., fit within the inner channel with only a small gap "i" between an outer surface of the angular cap and an inner surface of the support beam. However, dependent on the positions and orientation of the spline grooves, the insert may fit within the inner channel of the support beam with larger gaps ('h', 'g') between certain outer surfaces of the angular cap and certain inner surfaces of the support beam. In such a case, fastening means may be positioned along only certain surfaces of the support beam/insert combination.

According to certain aspects, combinations of support beams (20, 30, 20', 30') and inserts (100, 100') may be provided as a kit for a screened enclosure. The kit may include support beams in any combination of height 'z' and width 'b', and inserts configured to fit within the support beams (i.e., heights 'e' and widths 'd' that allow the inserts to be accommodated within the inner channels of the support beams in the kit). Moreover, the kit may include support beams and insert of standard lengths, wherein the beams and insert would be cut to size during installation of a screened enclosure. Alternatively, the support beams and inserts may be provided in specific lengths as defined by a specific design of a screen enclosure.

The kit may further include fastening elements that allow the inserts to be secured within the support beams.

The kit may include precut screen panels sized to fit within openings of the enclosure and/or rolls or specific lengths of the elastomeric spline component. Alternatively, the screen material may be provided as a roll of material that is cut on site to fit within specific opening sized and configurations.

While specific embodiments of the invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

What is claimed is:

1. A beam system for a screened enclosure, the system comprising:

an elongated rectangular beam having flat exterior sides, an interior channel extending longitudinally therethrough, and at least three spline grooves each adjacent an edge of the elongated rectangular beam, wherein each of the spline grooves include an outward facing opening and a recessed portion, wherein the opening is configured to receive an edge of a screen panel and an elastomeric spline component to secure the screen panel to the rectangular beam, an insert sized and configured to fit within the interior channel of the rectangular beam, the insert comprising a central pillar having angular caps attached to opposing lateral ends, wherein the insert is configured to provide connection between two adjacent beams, wherein the angular caps each comprise a pentagon-shaped closed structure having two right angles, wherein a first side of the closed structure that meets second and third sides at internal right angles faces an inner side wall of the elongated rectangular beam, wherein the closed structure is connected to the central pillar via a vertex of a fourth and fifth side of closed structure, wherein the angular caps of the insert each include a plurality of apertures in the second and third sides extending along a longitudinal length thereof, and the elongated rectangular beam includes apertures alignable with a portion of or all of the plurality of apertures of the insert, wherein aligned apertures of the elongated rectangular beam and the insert are each configured to accept a fastening element.

2. The beam system of claim 1, wherein a first exterior side of the elongated rectangular beam comprises a first spline groove that extends longitudinally along a length thereof, and a second exterior side adjacent to the first exterior side comprises second and third spline grooves that extend longitudinally along a length thereof.

3. The beam system of claim 2, wherein the first exterior side and a third exterior side are sidewalls of the elongated rectangular beam each having a length less than the second exterior side and a fourth exterior side, which are top and bottom walls of the elongated rectangular beam, and wherein each of the third and fourth sides of the elongated rectangular beam are absent spline grooves.

4. The beam system of claim 1, having four spline grooves each adjacent an edge of the elongated rectangular beam.

5. The beam system of claim 4, wherein each of a second and forth exterior side of the elongated rectangular beam are congruent sides and comprise a first and second spline groove that extends longitudinally along a length thereof, and a third exterior side of the elongated rectangular beam comprises a third and fourth spline groove that extends longitudinally along a length thereof.

6. A beam system for a screened enclosure, the system comprising:

an elongated rectangular beam having flat exterior sides, an interior channel extending longitudinally therethrough, and at least three spline grooves each adjacent an edge of the elongated rectangular beam, wherein each of the spline grooves include an outward facing opening and a recessed portion, wherein the opening is configured to receive an edge of a screen panel and an elastomeric spline component to secure the screen panel to the rectangular beam, an insert sized and configured to fit within the interior channel of the rectangular beam, the insert comprising a central pillar having angular caps attached to opposing lateral ends, wherein the insert is configured to provide connection between two adjacent beams, wherein the angular caps each comprise a first flat portion attached to the central pillar perpendicular thereto, two angled portions each attached to an opposite end of the first flat portion and extending outward away from the central pillar but inward toward a middle of the central pillar, and two second flat portions each attached to an end of the second angled portions and extending parallel with and inward toward a middle of the central pillar, wherein the first flat portion of each angular cap fits against an inner side wall of the elongated rectangular beam, and wherein the second flat portions of each angular cap fit against inner top and bottom walls of the elongated rectangular beam, wherein the angular caps of the insert each include a plurality of apertures in the second flat portions extending along a longitudinal length thereof, and the elongated rectangular beam includes apertures alignable with a portion of or all of the plurality of apertures in the second flat portions of each angular cap, wherein aligned apertures of the elongated rectangular beam and the insert are each configured to accept a fastening element.

7. The beam system of claim 6, wherein a first exterior side of the elongated rectangular beam comprises a first spline groove that extends longitudinally along a length thereof, and a second exterior side adjacent to the first exterior side comprises second and third spline grooves that extend longitudinally along a length thereof.

8. The beam system of claim 7, wherein the first exterior side and a third exterior side are sidewalls of the elongated rectangular beam each having a length less than the second exterior side and a fourth exterior side, which are top and bottom walls of the elongated rectangular beam, and wherein each of the third and fourth sides of the elongated rectangular beam are absent spline grooves.

9. The beam system of claim 6, having four spline grooves each adjacent an edge of the elongated rectangular beam.

10. The beam system of claim 9, wherein each of a second and forth exterior side of the elongated rectangular beam are congruent sides and comprise a first and second spline groove that extends longitudinally along a length thereof, and a third exterior side of the elongated rectangular beam comprises a third and fourth spline groove that extends longitudinally along a length thereof.

11. A kit for construction of a screened enclosure, the kit comprising:

a plurality of the beam systems according to claim 1.

12. A kit for construction of a screened enclosure, the kit comprising:

a plurality of the beam systems according to claim 1;

a quantity of screen material configured to fill openings in the screened enclosure between adjacent elongated rectangular beams; and a quantity of elastomeric spline component configured to secure the screen material within the openings in the screened enclosure between the adjacent elongated rectangular beams, wherein each of the spline grooves include an outward facing opening and a recessed portion, wherein the outward facing opening is configured to receive an edge of the screen material and a length of the elastomeric spline component configured to secure the screen material to each respective rectangular beam.

13. The kit of claim 12, having four spline grooves each adjacent an edge of the respective elongated rectangular beam.

14. The kit of claim 13, wherein each of a second and forth exterior side of the respective elongated rectangular beam are congruent sides and comprise a first and second spline groove that extends longitudinally along a length thereof, and a third exterior side of the respective elongated rectangular beam comprises a third and fourth spline groove that extends longitudinally along a length thereof.

15. A kit for construction of a screened enclosure, the kit comprising:

a plurality of the beam systems according to claim 6.

16. A kit for construction of a screened enclosure, the kit comprising:

a plurality of the beam systems according to claim 6;

a quantity of screen material configured to fill openings in the screened enclosure between adjacent elongated rectangular beams; and a quantity of elastomeric spline component configured to secure the screen material within the openings in the screened enclosure between the adjacent elongated rectangular beams, wherein each of the spline grooves include an outward facing opening and a recessed portion, wherein the outward facing opening is configured to receive an edge of the screen material and a length of the elastomeric spline component configured to secure the screen material to each respective rectangular beam.

17. The kit of claim 16, having four spline grooves each adjacent an edge of the respective elongated rectangular beam.

18. The kit of claim 17, wherein each of a second and forth exterior side of the respective elongated rectangular beam are congruent sides and comprise a first and second spline groove that extends longitudinally along a length thereof, and a third exterior side of the respective elongated rectangular beam comprises a third and fourth spline groove that extends longitudinally along a length thereof.

* * * * *